US011653156B2

(12) United States Patent
Tiefenau

(10) Patent No.: US 11,653,156 B2
(45) Date of Patent: May 16, 2023

(54) SOURCE SEPARATION IN HEARING DEVICES AND RELATED METHODS

(71) Applicant: GN Hearing A/S, Ballerup (DK)

(72) Inventor: Andreas Tiefenau, Ballerup (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 17/334,675

(22) Filed: May 28, 2021

(65) Prior Publication Data

US 2021/0289300 A1 Sep. 16, 2021

Related U.S. Application Data

(63) Continuation of application No. PCT/EP2019/086896, filed on Dec. 23, 2019.

(30) Foreign Application Priority Data

Dec. 21, 2018 (EP) ..... 18215415

(51) Int. Cl.
*H04R 25/00* (2006.01)

(52) U.S. Cl.
CPC ..... *H04R 25/507* (2013.01); *H04R 25/43* (2013.01); *H04R 2225/43* (2013.01); *H04R 2225/51* (2013.01)

(58) Field of Classification Search
CPC ..... H04R 25/507; H04R 2225/43; H04R 2225/55; G10L 15/25
See application file for complete search history.

(56) References Cited

U.S. PATENT DOCUMENTS

| | | | | |
|---|---|---|---|---|
| 5,754,661 | A | 5/1998 | Weinfurtner | |
| 9,264,824 | B2 * | 2/2016 | Pruthi | G02B 27/017 |
| 10,516,938 | B2 * | 12/2019 | Zass | G06F 40/10 |
| 10,580,430 | B2 * | 3/2020 | Jain | G10L 21/0364 |
| 11,122,373 | B2 * | 9/2021 | Jensen | G06V 40/168 |
| 11,270,198 | B2 * | 3/2022 | Busch | G06N 3/0635 |
| 11,270,688 | B2 * | 3/2022 | Lu | G06N 3/049 |

(Continued)

FOREIGN PATENT DOCUMENTS

WO WO 2018/053225 3/2018

OTHER PUBLICATIONS

"Looking to Listen at the Cocktail Party: A Speaker-Independent Audio-Visual Model for Speech Separation" by Ephrat, Ariel et al., arXiv:1804.03619v1 [cs.SD], Apr. 10, 2018 https://www.youtube.com/watch?v=uKwUL7vt03M.

(Continued)

*Primary Examiner* — Ryan Robinson
(74) *Attorney, Agent, or Firm* — Vista IP Law Group, LLP

(57) ABSTRACT

Hearing device, accessory device, and a method of operating a hearing system comprising a hearing device and an accessory device is disclosed, the method comprising obtaining, in the accessory device, an audio input signal representative of audio from one or more audio sources; obtaining image data with a camera of the accessory device; identifying one or more audio sources including a first audio source based on the image data; determining a first model comprising first model coefficients, wherein the first model is based on image data of the first audio source and the audio input signal; and transmitting a hearing device signal to the hearing device, wherein the hearing device signal is based on the first model.

17 Claims, 5 Drawing Sheets

(56) References Cited

U.S. PATENT DOCUMENTS

| | | | | |
|---|---|---|---|---|
| 11,317,233 | B2 * | 4/2022 | Koike | G10K 15/08 |
| 11,343,620 | B2 * | 5/2022 | Elmedyb | H04R 25/552 |
| 2002/0116197 | A1 * | 8/2002 | Erten | G06K 9/6292 704/E15.042 |
| 2003/0063763 | A1 * | 4/2003 | Allred | H04R 25/70 381/314 |
| 2009/0028363 | A1 * | 1/2009 | Frohlich | H04R 5/04 381/309 |
| 2011/0106508 | A1 * | 5/2011 | Boretzki | H04R 25/558 703/2 |
| 2011/0293123 | A1 * | 12/2011 | Neumeyer | H04R 25/558 707/E17.08 |
| 2015/0149169 | A1 | 5/2015 | Chang | |
| 2015/0172830 | A1 | 6/2015 | Liu et al. | |
| 2015/0279364 | A1 * | 10/2015 | Krishnan | G10L 25/57 704/251 |
| 2016/0183014 | A1 * | 6/2016 | Guo | G06V 40/171 381/313 |
| 2017/0188173 | A1 | 6/2017 | Ranieri et al. | |
| 2017/0295439 | A1 | 10/2017 | Xu et al. | |
| 2022/0021985 | A1 * | 1/2022 | Wexler | G10L 25/51 |

OTHER PUBLICATIONS

Extended European Search Report for EP Patent Appln. No. 18215415.3 dated Aug. 30, 2019.

PCT International Search Report and Written Opinion for International Appln. No. PCT/EP2019/086896, Applicant GN Hearing A/S, dated Feb. 21, 2020 (12 pages).

* cited by examiner

SOURCE SEPARATION IN HEARING DEVICES AND RELATED METHODS

RELATED APPLICATION DATA

This application is a continuation of International Patent Application No. PCT/EP2019/086896 filed on Dec. 23, 2019, which claims priority to European Patent Application No. 18215415.3 filed on Dec. 21, 2018. The entire disclosures of the above applications are expressly incorporated by reference herein.

FIELD

The present disclosure relates to a hearing device and an accessory device of a hearing system and related methods including a method of operating a hearing device.

BACKGROUND

In hearing device processing, a situation where the hearing device user is in a multi-source environment with a plurality of voices and/or other sound sources, the so-called cocktail party situation, continuously presents a challenge to the hearing device developers.

The problem with the cocktail party situation is, to separate a single voice out of a plurality of other voices in the same frequency range and similar proximity as the target voice signal. In recent years single-sided (classical) beamformers as well as bilateral beamformers have become the standard solution for hearing aids. The ability of beamformers in near field and/or reverberant situations is not always sufficient to provide a satisfactory listening experience. Usually, the performance of a beam former is increased by narrowing the beam and thereby suppressing the sources outside the beam stronger.

However, in real life sound sources and/or the head of the hearing aid user are moving and therefore generating a situation, where the desired source can move in and out of the beam, which can lead to a rather confusing acoustic situation.

SUMMARY

Accordingly, there is a need for hearing devices and methods with improved separation of sound sources.

A method of operating a hearing system comprising a hearing device and an accessory device, the method comprising obtaining, in the accessory device, an audio input signal representative of audio from one or more audio sources; obtaining image data with a camera of the accessory device; identifying one or more audio sources including a first audio source based on the image data; determining a first model comprising first model coefficients, wherein the first model is based on image data of the first audio source and the audio input signal; and transmitting a hearing device signal to the hearing device, wherein the hearing device signal is based on the first model.

Further, an accessory device for a hearing system comprising the accessory device and a hearing device, the accessory device comprising a processing unit, a memory, a camera, and an interface is disclosed. The processing unit is configured to obtain an audio input signal representative of audio from one or more audio sources; obtain image data with the camera; identify one or more audio sources including a first audio source based on the image data; determine a first model comprising first model coefficients, wherein the first model is based on image data of the first audio source and the audio input signal; and transmit a hearing device signal to the hearing device, wherein the hearing device signal is based on the first model.

The present disclosure additionally provides a hearing device comprising an antenna for converting a hearing device signal from an accessory device to an antenna output signal; a radio transceiver coupled to the antenna for converting the antenna output signal to a transceiver input signal; a set of microphones comprising a first microphone for provision of a first input signal; a processor for processing the first input signal and providing an electrical output signal based on the first input signal; and a receiver for converting the electrical output signal to an audio output signal. The hearing device signal comprises first model coefficients of a deep neural network, and wherein the processor is configured to process the first input signal based on the first model coefficients for provision of the electrical output signal.

Also, a hearing system comprising an accessory device and a hearing device. The accessory device may be an accessory device as described herein and the hearing device may be a hearing device as described herein.

The present disclosure allows for improved separation of sound sources in a hearing device in turn providing an improved listening experience for the user.

Further, the present disclosure provides a movement and/or position independent speaker separation and/or surrounding noise suppression in a hearing device.

The present disclosure further allows a user to select a sound source to listen to in an easy and effective way.

It is an important advantage that the accessory device (mobile phone, tablet, etc.) is used for image-assisted determination of a precise model for audio-only based audio separation. A hearing device signal (e.g. comprising first model parameters) based on the first model is transmitted to the hearing device allowing the hearing device to use the first model when processing a first input signal representative of audio from one or more audio sources. This in turn provides improved listening experience for a user in noisy environments by exploiting the excessive computing, battery, and communication capabilities (compared to the hearing device) and image recording and display capabilities of the accessory device for obtaining the first model that is used in the hearing device for processing incoming audio allowing to in an improved way separate the desired audio source from other sources.

BRIEF DESCRIPTION OF THE DRAWINGS

The above and other features and advantages of the present invention will become readily apparent to those skilled in the art by the following detailed description of exemplary embodiments thereof with reference to the attached drawings, in which.

DETAILED DESCRIPTION

Figure 1:
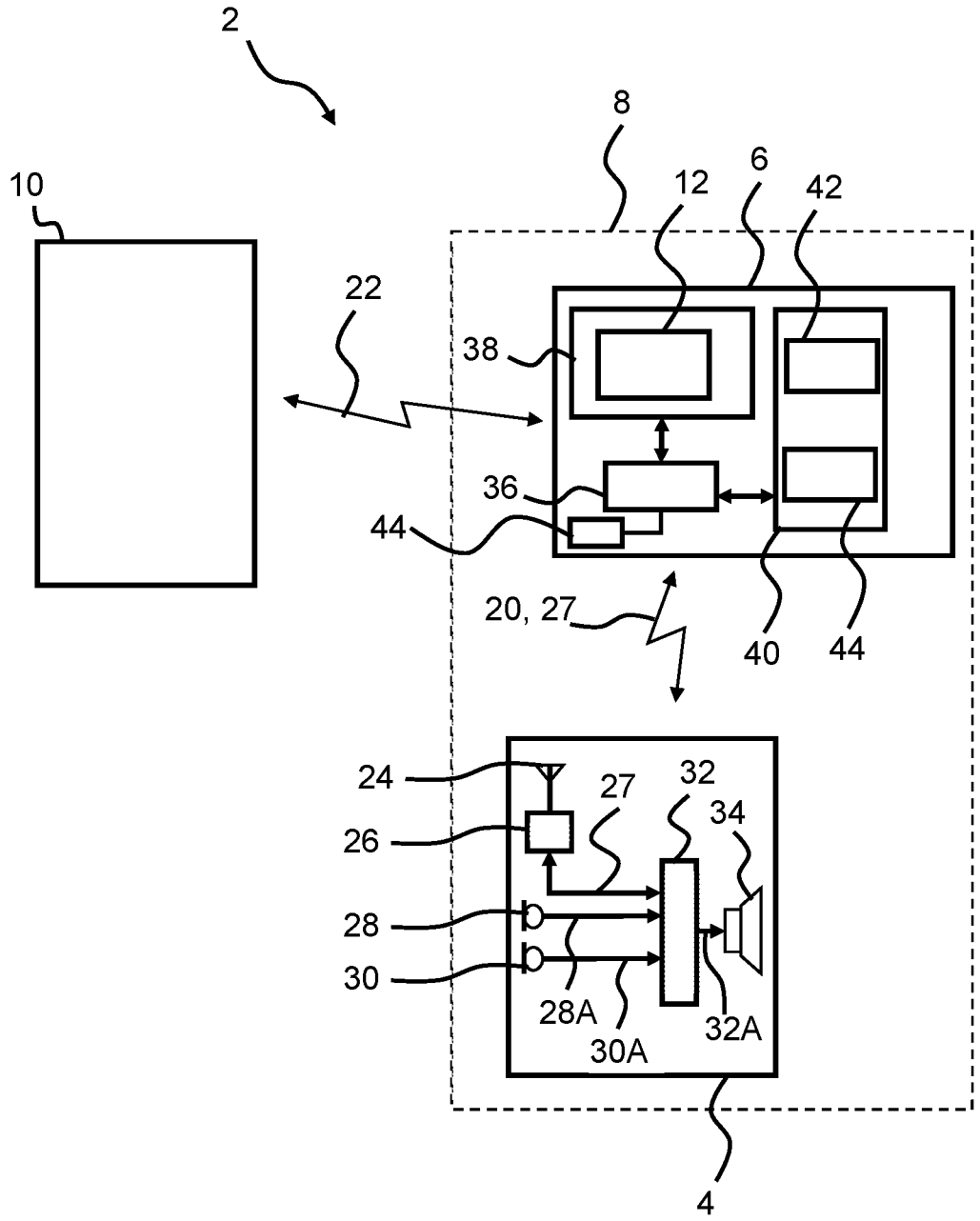
FIG. 1 schematically illustrates an exemplary hearing system.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

A hearing device is disclosed. The hearing device may be a hearable or a hearing aid, wherein the processor is configured to compensate for a hearing loss of a user.

The hearing device may be of the behind-the-ear (BTE) type, in-the-ear (ITE) type, in-the-canal (ITC) type, receiver-in-canal (RIC) type or receiver-in-the-ear (RITE) type. The hearing aid may be a binaural hearing aid. The hearing device may comprise a first earpiece and a second earpiece, wherein the first earpiece and/or the second earpiece is an earpiece as disclosed herein.

A method of operating a hearing system is disclosed. The hearing system comprises a hearing device and an accessory device.

The term "accessory device" as used herein refers to a device that is able to communicate with the hearing device. The accessory device may refer to a computing device under the control of a user of the hearing device. The accessory device may comprise or be a handheld device, a tablet, a personal computer, a mobile phone, such as a smartphone. The accessory device may be configured to communicate with the hearing device via the interface. The accessory device may be configured to control operation of the hearing device, e.g. by transmitting information to the hearing device. The interface of the accessory device may comprise a touch-sensitive display device.

The present disclosure provides an accessory device, the accessory device forming part of a hearing system comprising the accessory device and a hearing device. The accessory device comprises a memory; a processing unit coupled to the memory; and an interface coupled to the processing unit. Further, the accessory device comprises a camera for obtaining image data. The interface is configured to communicate with the hearing device of the hearing system and/or other devices.

The method comprises obtaining, in the accessory device, an audio input signal representative of audio from one or more audio sources. Obtaining an audio input signal representative of audio from one or more audio sources may comprise detecting the audio with one or more microphones of the accessory device.

In one or more exemplary methods/accessory devices, the audio input signal may be based on a wireless input signal from an external source, such as spouse microphone device(s), wireless TV audio transmitter, and/or a distributed microphone array associated with a wireless transmitter.

The method comprises obtaining image data with a camera of the accessory device. The image data may comprise moving image data also denoted video image data.

The method comprises identifying, e.g. with accessory device, one or more audio sources including a first audio source based on the image data. Identifying one or more audio sources including a first audio source based on the image data may comprise applying a face recognition algorithm to the image data.

The method comprises determining, e.g. in the accessory device, a first model comprising first model coefficients, wherein the first model is based on image data of the first audio source and the audio input signal. Accordingly, the method comprises in-situ determination of the first model, the first model then being applied in-situ in the hearing device or in the accessory device.

The first model is a model of the first audio source e.g. a speech model of the first audio source. The first model may be a deep neural network (DNN) defined (or at least partly defined) by DNN coefficients. Accordingly, the first model coefficients may be DNN coefficients of a DNN. The first model or first model coefficients may be applied in a (speech) separation process, e.g. in the hearing device processing the first input signal or in the accessory device, in order to separate out e.g. speech of the first audio source from the first input signal. In other words, processing the first input signal in the hearing device may comprise applying a DNN as the first model (and thus based on the first model coefficients) to the first input signal for provision of the electrical output signal. The first model/first model coefficients may represent or be indicative of parameters applied in a blind-source separation algorithm performed in the hearing device as part of processing the first input signal based on the first model. Accordingly, the first model may be a blind source separation model also denoted a BSS model, such as an audio-only BSS model. An audio-only BSS model only receives input representative of audio as input. The first model may be a speech separation model, e.g. allowing separation of speech from an input signal representative of audio.

Determining a first model comprising first model coefficients may comprise determining a first speech signal based on image data of the first audio source and the audio input signal. An example on image-assisted speech/audio source separation can be found in "Looking to Listen at the Cocktail Party: A Speaker-Independent Audio-Visual Model for Speech Separation" by Ephrat, Ariel et al., arXiv: 1804.03619v1 [cs.SD], 10 Apr. 2018. Accordingly, a second DNN/second model may be trained and/or applied in the accessory device for provision of the first speech signal based on image data of the first audio source and the audio input signal.

Determining a first model comprising first model coefficients may comprise determining the first model based on the first speech input signal. In other words, image-assisted audio source separation may be used for provision of a first speech input signal of high quality (clean speech with low or no noise) and wherein the first speech input signal (e.g. representing clean speech from the first audio source) is then used for determining/training the first model, and thus obtaining a precise first model of first audio from the first audio source. It is an advantage of the present disclosure that the determination of the first model, which requires heavy processing power at least compared to the processing capabilities of the hearing device, is performed at least partly on the spot or in situ in the accessory device, and that the application of the first model, which is less computationally demanding than the determination/training of the first model can be performed in the hearing device, in turn providing an electrical output signal/audio output signal with a small delay, e.g. substantially in real-time. This is important for the user experience since un-synchronized lip movements and audio (e.g. audio delayed too much compared to the corresponding lip movements) are annoying and confusing to the user of the hearing device and may even be detrimental to the understanding of a person speaking to the hearing device user.

The first speech input signal may be used for determining the first model, such as training an initial first model based on or with the first speech input signal to obtain the first model/first model coefficients of the first model. In other words, image-assisted speech separation is performed in the accessory device for in turn training a first model that is then transmitted to the hearing device and being used in audio-only blind source separation of a first input signal. Thus, the accessory device advantageously provides or determines a precise first model of the first audio source in substantially real-time or with a small delay of a few seconds or minutes that is then used by the hearing device for audio-only based audio source separation in the hearing device.

The method comprises transmitting, e.g. wirelessly transmitting, a hearing device signal to the hearing device, wherein the hearing device signal is based on the first model. Transmitting a hearing device signal to the hearing device may comprise transmitting first model coefficients to the hearing device. In other words, the hearing device signal may comprise and/or be indicative of the first model coefficients of the first model. Transmitting a hearing device signal including first model/first model coefficients determined in the accessory device to the hearing device may allow the hearing device to provide an audio output signal with improved source separation and a small delay by applying the first model/first model coefficients, e.g. in an source separation processing algorithm as part of processing the first input signal. The first model coefficients may be indicative of or corresponds to BSS/DNN coefficients for an audio-only blind source separation.

Accordingly, the method may comprise determining a hearing device signal based on the first model.

In one or more exemplary methods, the method comprises, in the hearing device, obtaining, in the hearing device, a first input signal representative of audio from one or more audio sources; processing, in the hearing device, the first input signal based on the first model coefficients for provision of an electrical output signal; and converting, in the hearing device, the electrical output signal to an audio output signal.

Obtaining, in the hearing device, a first input signal representative of audio from one or more audio sources may comprise detecting the audio with one or more microphones of the hearing device. Obtaining, in the hearing device, a first input signal representative of audio from one or more audio sources may comprise wirelessly receiving the first input signal.

In one or more exemplary methods, processing the first input signal based on the first model coefficients comprises applying blind source separation to the first input signal.

In one or more exemplary methods, processing the first input signal based on the first model coefficients comprises applying a deep neural network to the first input signal, wherein the deep neural network is based on the first model coefficients.

In one or more exemplary methods, identifying one or more audio sources comprises determining a first position of the first audio source based on the image data, displaying, e.g. on touch-sensitive display device of the accessory device, a first user interface element indicative of the first audio source, and detecting a user input selecting the first user interface element. The method may comprise, in accordance with detecting a user input selecting the first user interface element, determining first image data of the image data, the first image data associated with the first audio source.

Determining a first model comprising first model coefficients, wherein the first model is based on image data optionally comprises determining a first model comprising first model coefficients, wherein the first model is based on first image data. In other words, determining a first model comprising first model coefficients optionally comprises determining the first model based on first image data associated with the first audio source.

Displaying, e.g. on touch-sensitive display device of the accessory device, a first user interface element indicative of the first audio source, may comprise overlaying the first user interface element on at least a part of the image data, e.g. an image of the image data. The first user interface element may be a frame element and/or an image of the first audio source.

In one or more exemplary methods, determining a first model comprises determining lip movements of the first audio source based on the image data, such as the first image data, and wherein the first model is based on the lip movements of the first audio source.

In one or more exemplary methods and/or accessory devices, the first model is a deep neural network DNN with N layers, wherein N is larger than 3. The DNN may have a number of hidden layers, also denoted N_hidden. The number of hidden layers of the DNN may be 2, 3, or more.

In one or more exemplary methods, determining a first model comprising first model coefficients comprises training the deep neural network based on the image data, such as the first image data for provision of the first model coefficients.

In one or more exemplary methods, the method comprises processing, in the accessory device, the first audio input signal based on the first model for provision of a first output signal. Transmitting a hearing device signal optionally comprises transmitting the first output signal to the hearing device. Accordingly, the hearing device signal may comprise or be indicative of the first output signal.

In one or more exemplary methods, identifying, e.g. with accessory device, one or more audio sources comprises identifying including a second audio source based on the image data. Identifying a second audio source based on the image data may comprise applying a face recognition algorithm to the image data.

In one or more exemplary methods, the method comprises determining a second model comprising second model coefficients, wherein the second model is based on image data of the second audio source and the audio input signal.

In one or more exemplary methods, transmitting a hearing device signal to the hearing device may comprise transmitting second model coefficients to the hearing device. In other words, the hearing device signal may comprise and/or be indicative of the second model coefficients of the second model. Accordingly, the method may comprise determining a hearing device signal based on the second model.

In one or more exemplary methods, the method comprises, in the hearing device, obtaining, in the hearing device, a first input signal representative of audio from one or more audio sources; processing, in the hearing device, the first input signal based on the second model coefficients for provision of an electrical output signal; and converting, in the hearing device, the electrical output signal to an audio output signal. The electrical output signal may be a sum of a first output signal and a second output signal, the first output signal resulting from processing the first input signal based on the first model coefficients and the second output signal resulting from processing the first input signal based on the second model coefficients.

In one or more exemplary methods, processing the first input signal based on the second model coefficients comprises applying blind source separation to the first input signal.

In one or more exemplary methods, processing the first input signal based on the second model coefficients comprises applying a deep neural network to the first input signal, wherein the deep neural network is based on the second model coefficients.

In one or more exemplary methods, identifying one or more audio sources comprises determining a second position of the second audio source based on the image data, displaying, e.g. on touch-sensitive display device of the accessory device, a second user interface element indicative of the second audio source, and detecting a user input selecting the second user interface element. The method may comprise, in accordance with detecting a user input selecting the second user interface element, determining second image data of the image data, the second image data associated with the second audio source.

Determining a second model comprising second model coefficients, wherein the second model is based on image data optionally comprises determining a second model comprising second model coefficients, wherein the second model is based on second image data. In other words, determining a second model comprising second model coefficients optionally comprises determining the second model based on second image data associated with the second audio source.

Displaying, e.g. on touch-sensitive display device of the accessory device, a second user interface element indicative of the second audio source, may comprise overlaying the second user interface element on at least a part of the image data, e.g. an image of the image data. The second user interface element may be a frame element and/or an image of the second audio source.

In one or more exemplary methods, determining a second model comprises determining lip movements of the second audio source based on the image data, such as the second image data, and wherein the second model is based on the lip movements of the second audio source.

The second model is a deep neural network DNN with N layers, wherein N is larger than 3. The DNN may have a number of hidden layers, also denoted N_hidden. The number of hidden layers of the DNN may be 2, 3, or more.

In one or more exemplary methods, determining a second model comprising second model coefficients comprises training the deep neural network based on the image data, such as the second image data, for provision of the second model coefficients.

In one or more exemplary methods, the method comprises processing, in the accessory device, the first audio input signal based on the second model for provision of a second output signal. Transmitting a hearing device signal optionally comprises transmitting the second output signal to the hearing device. Accordingly, the hearing device signal may comprise or be indicative of the second output signal.

Further an accessory device for a hearing system comprising the accessory device and a hearing device is disclosed. The accessory device comprises a processing unit, a memory, a camera, and an interface, wherein the processing unit is configured to obtain an audio input signal representative of audio from one or more audio sources. the processing unit is configured to obtain image data, such as video data, with the camera; identify one or more audio sources including a first audio source based on the image data;

determine a first model comprising first model coefficients, wherein the first model is based on image data of the first audio source and the audio input signal; and transmit a hearing device signal via the interface to the hearing device.

The hearing device signal is based on the first model. For example, the hearing device signal may comprise first model coefficients of the first model. Accordingly, to transmit a hearing device signal to the hearing device may comprise to transmit first model coefficients to the hearing device.

In one or more exemplary accessory devices, to identify one or more audio sources comprises determining a first position of the first audio source based on the image data, displaying, e.g. on a touch-sensitive display device of the interface, a first user interface element indicative of the first audio source, and detecting a user input selecting the first user interface element, e.g. with the touch-sensitive display device of the interface.

In one or more exemplary accessory devices, to determine a first model comprises determining lip movements of the first audio source based on the image data and wherein the first model is based on the lip movements of the first audio source.

In one or more exemplary accessory devices, to determine a first model comprising first model coefficients comprises training the first model being a deep neural network based on the image data for provision of the first model coefficients. Training the first model being a deep neural network based on the image data for provision of the first model coefficients may comprise determining a first speech input signal based on the image data and the audio input signal representative of audio from one or more audio sources, and training the first model based on the first speech input signal.

Training the deep neural network based on the image data may comprise training the deep neural network based on the lip movements of the first audio source, such as by determining a first speech input signal based on the lip movements, e.g. using image or video-assisted speech separation, and training the DNN (first model) based on the first speech input signal. Lip movements (based on the image data) of the first audio source may be indicative of presence of first audio originating from the first audio source in the audio input signal, i.e. the desired audio.

In one or more exemplary accessory devices, the processing unit is configured to process the first audio input signal based on the first model for provision of a first output signal, and wherein to transmit a hearing device signal comprises transmitting the first output signal to the hearing device. Thus, a cleaned audio input signal may be sent to the hearing device for direct use in the hearing compensation processing of the processor.

A hearing device is disclosed, the hearing device comprising an antenna for converting a hearing device signal from an accessory device to an antenna output signal; a radio transceiver coupled to the antenna for converting the antenna output signal to a transceiver input signal; a set of microphones comprising a first microphone for provision of a first input signal; a processor for processing the first input signal and providing an electrical output signal based on the first input signal; and a receiver for converting the electrical output signal to an audio output signal, wherein the hearing device signal comprises first model coefficients of a deep neural network, and wherein the processor is configured to process the first input signal based on the first model coefficients for provision of the electrical output signal.

FIG. 1 shows an exemplary hearing system. The hearing system 2 comprises a hearing device 4 and an accessory device 6. The hearing device 4 and the accessory device 6 may commonly be referred to as a hearing device system 8. The hearing system 2 may comprise a server device 10.

The accessory device 6 is configured to wirelessly communicate with the hearing device 4. A hearing application 12 is installed on the accessory device 6. The hearing application 12 may be for controlling and/or assisting the hearing device 4 and/or assisting a hearing device user. The accessory device 6/hearing application 12 may be configured to perform any acts of the method disclosed herein. The hearing device 4 may be configured to compensate for hearing loss of a user of the hearing device 4. The hearing device 4 is configured to configured to communicate with the accessory device 6/hearing application 12, e.g. using a wireless and/or wired first communication link 20. The first communication link 20 may be a single hop communication link or a multi-hop communication link. The first communication link 20 may be carried over a short-range communication system, such as Bluetooth, Bluetooth low energy, IEEE 802.11 and/or Zigbee.

The accessory device 6/hearing application 12 is optionally configured to connect to server device 10 over a network, such as the Internet and/or a mobile phone network, via a second communication link 22. The server device 10 may be controlled by the hearing device manufacturer.

The hearing device 4 comprises an antenna 24 and a radio transceiver 26 coupled to the antenna 24 for receiving/transmitting wireless communication including receiving hearing device signal 27 via first communication link 20. The hearing device 4 comprises a set of microphones comprising a first microphone 28, e.g. for provision of a first input signal based on first microphone input signal 28A. The set of microphones may comprise a second microphone 30. The first input signal may be based on second microphone input signal 30A from the second microphone 30. The first input signal may be based on the hearing device signal 27. The hearing device 4 comprises a processor 32 for processing the first input signal and providing an electrical output signal 32A based on the first input signal; and a receiver 34 for converting the electrical output signal 32A to an audio output signal.

The accessory device 6 comprises a processing unit 36, a memory unit 38, and interface 40. The hearing application 12 is installed in the memory unit 38 of the accessory device 6. The interface 40 comprises a wireless transceiver 42 for forming communication links 20, 22, and a touch-sensitive display device 44 for receiving user input.

Figure 2:
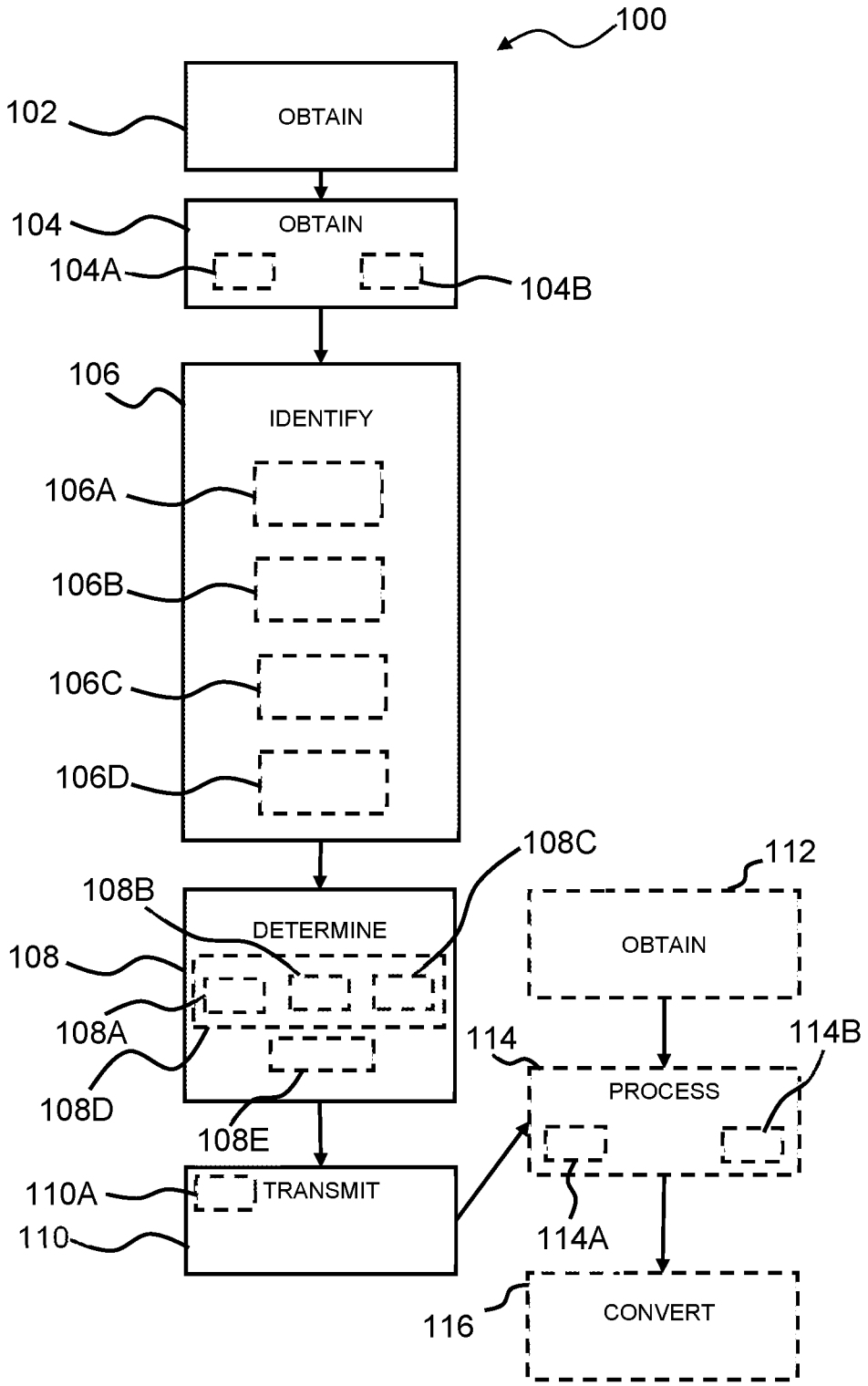
FIG. 2 is a flow diagram of an exemplary method according to the disclosure.

FIG. 2 is a flow diagram of an exemplary method of operating a hearing system comprising a hearing device and an accessory device. The method 100 comprises obtaining 102, in the accessory device, an audio input signal representative of audio from one or more audio sources; obtaining 104 image data with a camera of the accessory device; identifying 106 one or more audio sources including a first audio source based on the image data; determining 108 a first model M_1 comprising first model coefficients MC_1, wherein the first model M_1 is based on image data ID of the first audio source and the audio input signal; and transmitting 110 a hearing device signal to the hearing device, wherein the hearing device signal is based on the first model.

In method 100, identifying 106 one or more audio sources optionally comprises determining 106A a first position of the first audio source based on the image data, displaying 106B a first user interface element indicative of the first audio source, and detecting 106C a user input selecting the first user interface element. The method 100 may comprise, in accordance with detecting 106C a user input selecting the first user interface element, determining 106D first image data of the image data, the first image data associated with the audio source.

In method 100, determining 108 a first model M_1 optionally comprises determining 108A lip movements of the first audio source based on the image data, such as the first image data, and wherein the first model M_1 is based on the lip movements. In method 100, the first model is a deep neural network with N layers, wherein N is larger than 3.

In method 100, determining 108 a first model comprising first model coefficients optionally comprises training 108B the deep neural network based on the image data for provision of the first model coefficients. Determining 108 a first model comprising first model coefficients optionally comprises determining 108C the first model based on first image data associated with the first audio source.

Figure 6:
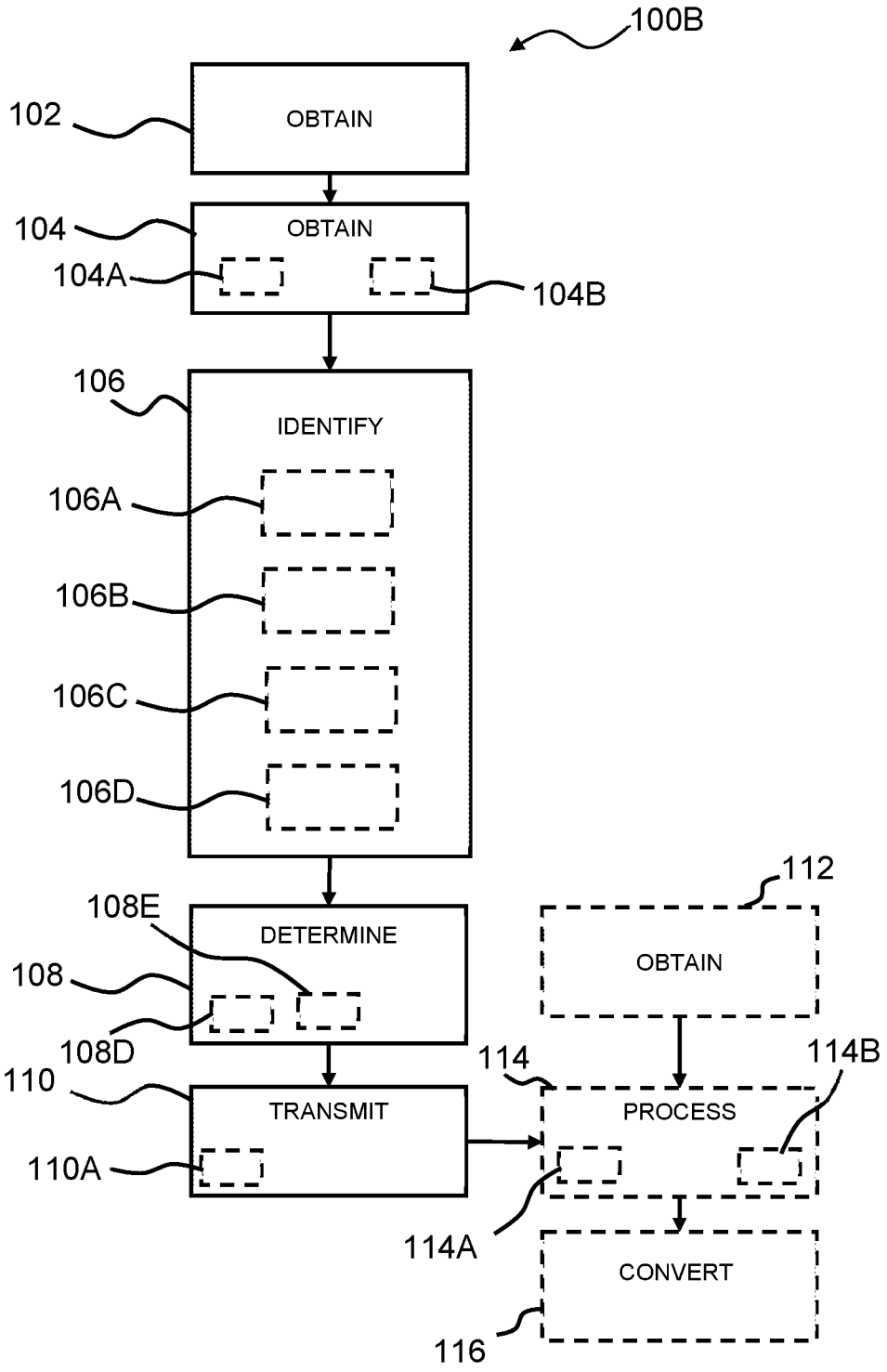
FIG. 6 is a flow diagram of an exemplary method according to the disclosure.

In method 100, determining 108 a first model comprising first model coefficients optionally comprises determining 108D a first speech input signal based on the image data and the audio input signal and training/determining 108E the first model based on the first speech input signal, see also FIG. 6. Determining 108D a first speech input signal based on the image data and the audio input signal may comprise determining lip movements of the first audio source based on the image data.

Transmitting 110 a hearing device signal to the hearing device optionally comprises transmitting 110A first model coefficients to the hearing device.

In one or more exemplary methods, the method 100 comprises, in the hearing device, obtaining 112 a first input signal representative of audio from one or more audio sources; processing 114 the first input signal based on the first model coefficients for provision of an electrical output signal; and converting 116 the electrical output signal to an audio output signal. Accordingly, acts 112, 114, 116 are performed by the hearing device.

In method 100, processing 114 the first input signal based on the first model coefficients optionally comprises applying 114A blind source separation BSS to the first input signal, wherein the blind source separation is based on the first model coefficients MC_1.

In method 100, processing 114 the first input signal based on the first model coefficients optionally comprises applying 114B a deep neural network DNN to the first input signal, wherein the deep neural network DNN is based on the first model coefficients MC_1.

Figure 3:
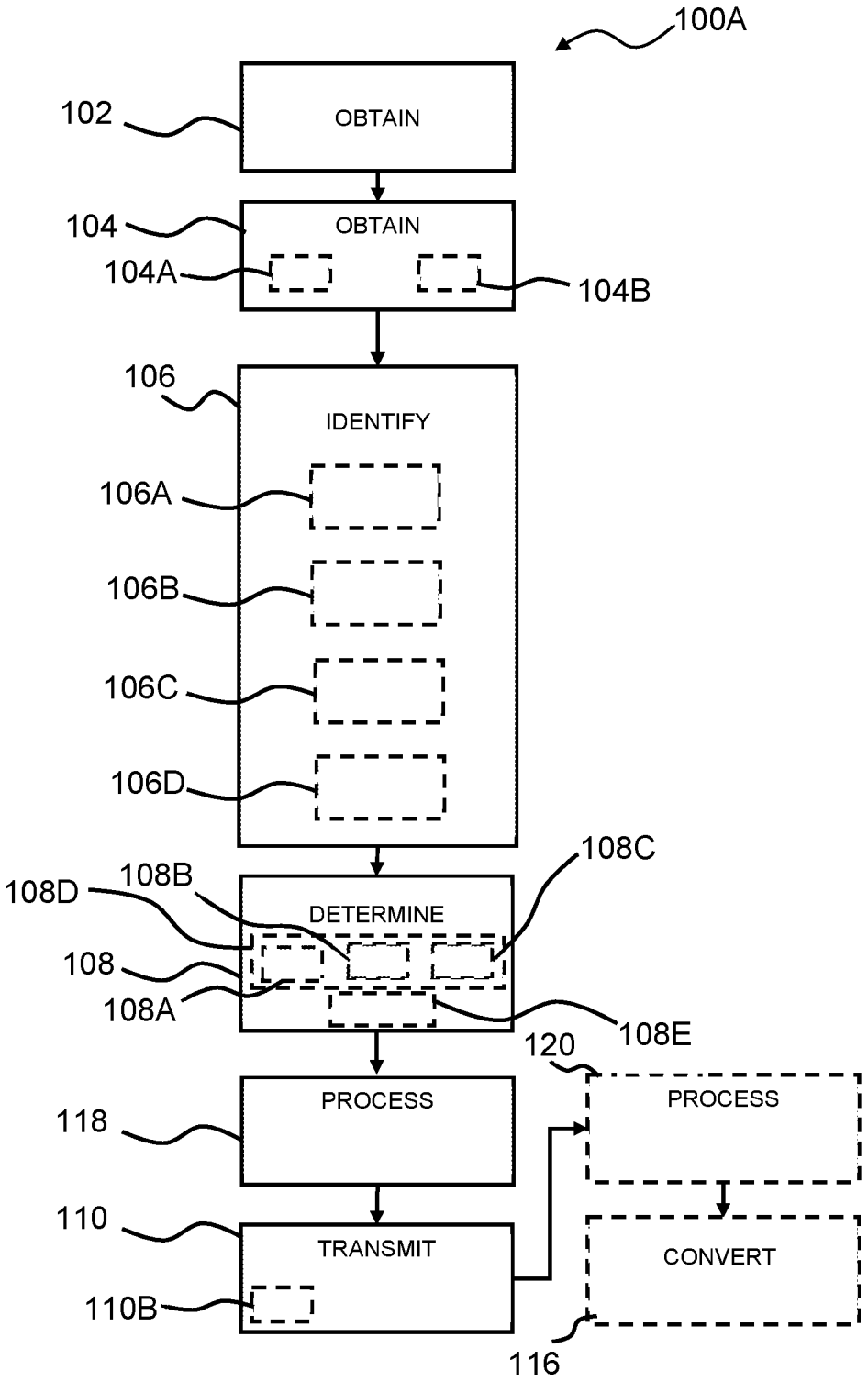
FIG. 3 is a flow diagram of an exemplary method according to the disclosure.

FIG. 3 is a flow diagram of an exemplary method of operating a hearing system comprising a hearing device and an accessory device. The method 100A comprises obtaining 102, in the accessory device, an audio input signal representative of audio from one or more audio sources; obtaining 104 image data with a camera of the accessory device; identifying 106 one or more audio sources including a first audio source based on the image data; determining 108 a first model M_1 comprising first model coefficients MC_1, wherein the first model M_1 is based on image data ID of the first audio source and the audio input signal; and transmitting 110 a hearing device signal to the hearing device, wherein the hearing device signal is based on the first model.

In method 100A, identifying 106 one or more audio sources optionally comprises determining 106A a first position of the first audio source based on the image data, displaying 106B a first user interface element indicative of the first audio source, and detecting 106C a user input selecting the first user interface element. The method 100A may comprise, in accordance with detecting 106C a user input selecting the first user interface element, determining 106D first image data of the image data, the first image data associated with the audio source.

In method 100A, determining 108 a first model M_1 optionally comprises determining 108A lip movements of the first audio source based on the image data, such as the first image data, and wherein the first model M_1 is based on the lip movements. In method 100A, the first model is a deep neural network with N layers, wherein N is larger than 3.

In method 100A, determining 108 a first model comprising first model coefficients optionally comprises training 108B the deep neural network based on the image data for provision of the first model coefficients. Determining 108 a first model comprising first model coefficients optionally comprises determining 108C the first model based on first image data associated with the first audio source.

The method 100A comprises processing 118, in the accessory device, the first audio input signal based on the first model for provision of a first output signal, and wherein transmitting 110 a hearing device signal comprises transmitting 110B the first output signal to the hearing device.

The method 100A comprises processing 120 the first output signal (received from the accessory device) for provision of an electrical output signal; and converting 116 the electrical output signal to an audio output signal. Accordingly, acts 120 and 116 are performed by the hearing device.

In method 100A, processing 114 the first input signal based on the first model coefficients optionally comprises applying 114A blind source separation BSS to the first input signal, wherein the blind source separation is based on the first model coefficients MC_1.

In method 100A, processing 114 the first input signal based on the first model coefficients optionally comprises applying 114B a deep neural network DNN to the first input signal, wherein the deep neural network DNN is based on the first model coefficients MC_1.

Figure 4:
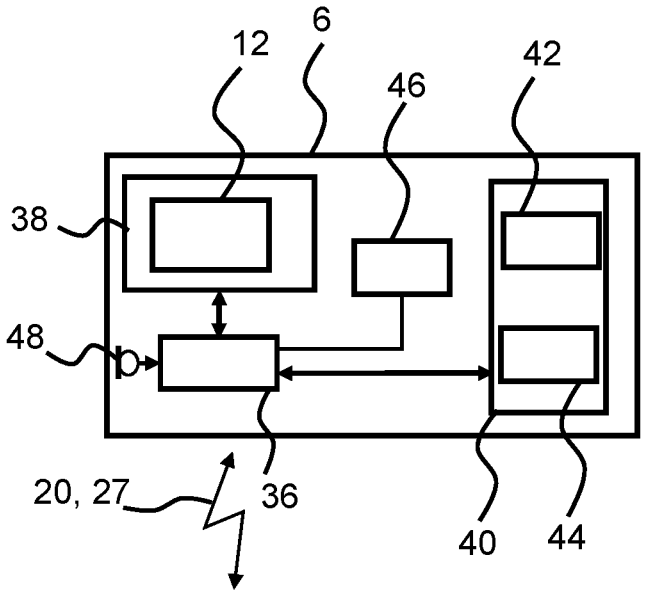
FIG. 4 is a block diagram of an exemplary accessory device.

FIG. 4 is a schematic block diagram of an exemplary accessory device. The accessory device 6 comprises a processing unit 36, a memory unit 38, and interface 40. The hearing application 12 is installed in the memory unit 38 of the accessory device 6. The interface 40 comprises a wireless transceiver 42 for forming communication links and a touch-sensitive display device 44 for receiving user input. Further, the accessory device comprises camera 46 for obtaining imaged data and microphone 48 for detecting audio from one or more audio sources.

The processing unit 36 is configured to obtain an audio input signal representative of audio from one or more audio sources with the microphone 48 and/or via wireless transceiver; obtain image data with the camera; identify one or more audio sources including a first audio source based on the image data; determine a first model comprising first model coefficients, wherein the first model is based on image data of the first audio source and the audio input signal; and transmit a hearing device signal to the hearing device, wherein the hearing device signal is based on the first model.

In accessory device 6, to transmit a hearing device signal to the hearing device optionally comprises to transmit first model coefficients to the hearing device. Further, to identify one or more audio sources comprises determining a first position of the first audio source based on the image data, displaying a first user interface element indicative of the first audio source, and detecting a user input selecting the first user interface element.

In accessory device 6, to determine a first model comprises determining lip movements of the first audio source based on the image data and wherein the first model is based on the lip movements of the first audio source. The first model is a deep neural network with N layers, wherein N is larger than 3, such as 4, 5, or more. To determine a first model comprising first model coefficients comprises training the deep neural network based on the image data for provision of the first model coefficients.

The processing unit 36 may be configured to process the first audio input signal based on the first model for provision of a first output signal, and wherein to transmit a hearing device signal comprises transmitting the first output signal to the hearing device.

Figure 5:
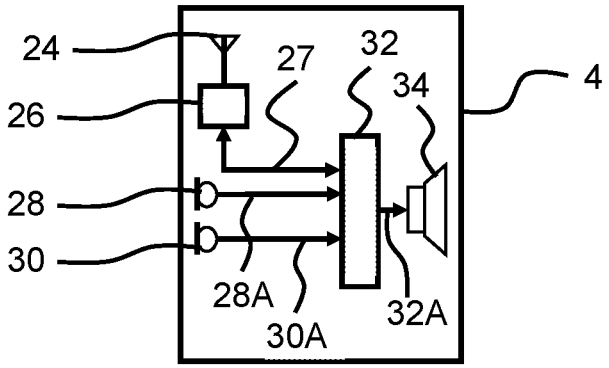
FIG. 5 is a block diagram of an exemplary hearing device.

FIG. 5 is a schematic block diagram of an exemplary hearing device. The hearing device 4 comprises an antenna 24 and a radio transceiver 26 coupled to the antenna 24 for receiving/transmitting wireless communication including receiving hearing device signal 27 via a communication link. The hearing device 4 comprises a set of microphones comprising a first microphone 28, e.g. for provision of a first input signal based on first microphone input signal 28A. The set of microphones may comprise a second microphone 30. The first input signal may be based on second microphone input signal 30A from the second microphone 30. The first input signal may be based on the hearing device signal 27. The hearing device 4 comprises a processor 32 for processing the first input signal and providing an electrical output signal 32A based on the first input signal; and a receiver 34 for converting the electrical output signal 32A to an audio output signal. The processor 32 is configured to process the first input signal based on the hearing device signal 27, e.g. based on first model coefficients of a deep neural network and/or second model coefficients of a deep neural network, and wherein the processor is configured to process the first input signal based on the first model coefficients and/or the second model coefficients for provision of the electrical output signal.

FIG. 6 is a flow diagram of an exemplary method of operating a hearing system comprising a hearing device and an accessory device similar to method 100. The method 100B comprises obtaining 102, in the accessory device, an audio input signal representative of audio from one or more audio sources; obtaining 104 image data with a camera of the accessory device; identifying 106 one or more audio sources including a first audio source based on the image data; determining 108 a first model M_1 comprising first model coefficients MC_1, wherein the first model M_1 is based on image data ID of the first audio source and the audio input signal; and transmitting 110 a hearing device signal to the hearing device, wherein the hearing device signal is based on the first model.

In method 1008, identifying 106 one or more audio sources optionally comprises determining 106A a first position of the first audio source based on the image data, displaying 106B a first user interface element indicative of the first audio source, and detecting 106C a user input selecting the first user interface element. The method 100 may comprise, in accordance with detecting 106C a user input selecting the first user interface element, determining 106D first image data of the image data, the first image data associated with the audio source.

In method 1008, determining 108 a first model M_1 comprising first model coefficients optionally comprises determining 108D a first speech input signal based on the image data and the audio input signal, and determining 108E the first model based on the first speech input signal. Determining 108E the first model based on the first speech input signal optionally comprises training the first model based on the first speech input signal.

Transmitting 110 a hearing device signal to the hearing device optionally comprises transmitting 110A first model coefficients to the hearing device.

In one or more exemplary methods, the method 100B comprises, in the hearing device, obtaining 112 a first input signal representative of audio from one or more audio sources; processing 114 the first input signal based on the first model coefficients for provision of an electrical output signal; and converting 116 the electrical output signal to an audio output signal. Accordingly, acts 112, 114, 116 are performed by the hearing device, such as hearing device 2.

In method 100B, processing 114 the first input signal based on the first model coefficients optionally comprises applying 114A blind source separation BSS to the first input signal, wherein the blind source separation is based on the first model coefficients MC_1.

In method 100B, processing 114 the first input signal based on the first model coefficients optionally comprises applying 114B a deep neural network DNN to the first input signal, wherein the deep neural network DNN is based on the first model coefficients MC_1.

Also disclosed are methods, accessory devices, hearing devices, and hearing systems according to any of the following items.

Item 1. A method of operating a hearing system comprising a hearing device and an accessory device, the method comprising a. obtaining, in the accessory device, an audio input signal representative of audio from one or more audio sources;

b. obtaining image data with a camera of the accessory device;

c. identifying one or more audio sources including a first audio source based on the image data;

d. determining a first model comprising first model coefficients, wherein the first model is based on image data of the first audio source and the audio input signal; and e. transmitting a hearing device signal to the hearing device, wherein the hearing device signal is based on the first model.

Item 2. Method according to item 1, wherein transmitting a hearing device signal to the hearing device comprises transmitting first model coefficients to the hearing device.

Item 3. Method according to item 2, the method comprising, in the hearing device, a. obtaining a first input signal representative of audio from one or more audio sources;

b. processing the first input signal based on the first model coefficients for provision of an electrical output signal; and c. converting the electrical output signal to an audio output signal.

Item 4. Method according to item 3, wherein processing the first input signal based on the first model coefficients comprises applying blind source separation to the first input signal.

Item 5. Method according to any of items 3-4, wherein processing the first input signal based on the first model coefficients comprises applying a deep neural network to the first input signal, wherein the deep neural network is based on the first model coefficients.

Item 6. Method according to any of items 1-5, wherein identifying one or more audio sources comprises determining a first position of the first audio source based on the image data, displaying a first user interface element indicative of the first audio source, and detecting a user input selecting the first user interface element.

Item 7. Method according to any of items 1-6, wherein determining a first model comprises determining lip movements of the first audio source based on the image data and wherein the first model is based on the lip movements.

Item 8. Method according to any of the items 1-7, wherein the first model is a deep neural network with N layers, wherein N is larger than 3.

Item 9. Method according to item 8, wherein determining a first model comprising first model coefficients comprises training the deep neural network based on the image data for provision of the first model coefficients.

Item 10. Method according to any of items 1-9, the method comprising processing, in the accessory device, the first audio input signal based on the first model for provision of a first output signal, and wherein transmitting a hearing device signal comprises transmitting the first output signal to the hearing device.

Item 11. Accessory device for a hearing system comprising the accessory device and a hearing device, the accessory device comprising a processing unit, a memory, a camera, and an interface, wherein the processing unit is configured to:

a. obtain an audio input signal representative of audio from one or more audio sources;

b. obtain image data with the camera;

c. identify one or more audio sources including a first audio source based on the image data;

d. determine a first model comprising first model coefficients, wherein the first model is based on image data of the first audio source and the audio input signal; and e. transmit a hearing device signal to the hearing device, wherein the hearing device signal is based on the first model.

Item 12. Accessory device according to item 11, wherein to transmit a hearing device signal to the hearing device comprises to transmit first model coefficients to the hearing device.

Item 13. Accessory device according to any of items 11-12, wherein to identify one or more audio sources comprises determining a first position of the first audio source based on the image data, displaying a first user interface element indicative of the first audio source, and detecting a user input selecting the first user interface element.

Item 14. Accessory device according to any of items 11-13, wherein to determine a first model comprises determining lip movements of the first audio source based on the image data and wherein the first model is based on the lip movements.

Item 15. Accessory device according to any of the items 11-14, wherein the first model is a deep neural network with N layers, wherein N is larger than 3.

Item 16. Accessory device according to item 15, wherein to determine a first model comprising first model coefficients comprises training the deep neural network based on the image data for provision of the first model coefficients.

Item 17. Accessory device according to any of items 11-16, wherein the processing unit is configured to process the first audio input signal based on the first model for provision of a first output signal, and wherein to transmit a hearing device signal comprises transmitting the first output signal to the hearing device.

Item 18. A hearing device comprising:

a. an antenna for converting a hearing device signal from an accessory device to an antenna output signal;

b. a radio transceiver coupled to the antenna for converting the antenna output signal to a transceiver input signal;

c. a set of microphones comprising a first microphone for provision of a first input signal;

d. a processor for processing the first input signal and providing an electrical output signal based on the first input signal; and e. a receiver for converting the electrical output signal to an audio output signal, wherein the hearing device signal comprises first model coefficients of a deep neural network, and wherein the processor is configured to process the first input signal based on the first model coefficients for provision of the electrical output signal.

Item 19. A hearing system comprising an accessory device according to any of items 11-17 and a hearing device according to item 18.

Item 20. Method according to any of items 1-9, wherein determining a first model comprising first model coefficients comprises determining a first speech input signal based on the image data and the audio input signal, and determining the first model based on the first speech input signal.

Item 21. Method according to item 20, wherein determining the first model based on the first speech input signal comprises training the first model based on the first speech input signal.

The use of the terms "first", "second", "third" and "fourth", "primary", "secondary", "tertiary" etc. does not imply any particular order, but are included to identify individual elements. Moreover, the use of the terms "first", "second", "third" and "fourth", "primary", "secondary", "tertiary" etc. does not denote any order or importance, but rather the terms "first", "second", "third" and "fourth", "primary", "secondary", "tertiary" etc. are used to distinguish one element from another. Note that the words "first", "second", "third" and "fourth", "primary", "secondary", "tertiary" etc. are used here and elsewhere for labelling purposes only and are not intended to denote any specific spatial or temporal ordering.

Furthermore, the labelling of a first element does not imply the presence of a second element and vice versa.

It may be appreciated that FIGS. 1-5 comprise some modules or operations which are illustrated with a solid line and some modules or operations which are illustrated with a dashed line. The modules or operations which are comprised in a solid line are modules or operations which are comprised in the broadest example embodiment. The modules or operations which are comprised in a dashed line are example embodiments which may be comprised in, or a part of, or are further modules or operations which may be taken in addition to the modules or operations of the solid line example embodiments. It should be appreciated that these operations need not be performed in order presented. Furthermore, it should be appreciated that not all of the operations need to be performed. The exemplary operations may be performed in any order and in any combination.

It is to be noted that the word "comprising" does not necessarily exclude the presence of other elements or steps than those listed.

It is to be noted that the words "a" or "an" preceding an element do not exclude the presence of a plurality of such elements.

It should further be noted that any reference signs do not limit the scope of the claims, that the exemplary embodiments may be implemented at least in part by means of both hardware and software, and that several "means", "units" or "devices" may be represented by the same item of hardware.

The various exemplary methods, devices, and systems described herein are described in the general context of method steps processes, which may be implemented in one aspect by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), etc. Generally, program modules may include routines, programs, objects, components, data structures, etc. that perform specified tasks or implement specific abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

LIST OF REFERENCES

2 hearing system
4 hearing device
6 accessory device
8 hearing device system
10 server device
12 hearing application
20 first communication link
22 second communication link
24 antenna
26 radio transceiver
27 hearing device signal
27 first microphone
28A first microphone input signal
30 second microphone
30A second microphone input signal
32 processor
34 receiver
36 processing unit
38 memory unit
40 interface
42 wireless transceiver
44 touch-sensitive display device
46 camera
48 microphone
100, 100A, 100B method of operating a hearing system
102 obtaining, in the accessory device, an audio input signal representative of audio from one or more audio sources
104 obtaining image data with a camera of the accessory device
106 identifying one or more audio sources including a first audio source and/or a second audio source based on the image data

106A determining a first position of the first audio source and/or a second position of the second audio source based on the image data

106B displaying a first user interface element indicative of the first audio source and/or a second user interface element indicative of the second audio source

106C detecting a user input selecting the first user interface element and/or the second user interface element

106D determining first image data of the image data, the first image data associated with the first audio source and/or determining second image data of the image data, the second image data associated with the second audio source

108 determining a first model and/or a second model based on image data

108A determining lip movements of the first audio source and/or lip movements of the second audio source based on the image data

108B training the deep neural network(s)

108C determining the first model based on first image data associated with the first audio source and/or determining the second model based on second image data associated with the second audio source

108D determining a first speech input signal based on the image data and the audio input signal

108E training/determining the first model based on the first speech input signal

110 transmitting a hearing device signal to the hearing device

110A transmitting first model coefficients and/or second model coefficients to the hearing device

1108 transmitting the first output signal to the hearing device

112 obtaining a first input signal representative of audio from one or more audio sources

114 processing the first input signal based on the first model coefficients and/or the second model coefficients for provision of an electrical output signal

114A applying blind source separation to the first input signal

1148 applying deep neural network(s) to the first input signal

116 converting the electrical output signal to an audio output signal

118 processing, in the accessory device, the audio input signal based on the first model and/or based on the second model for provision of a first output signal

120 processing the first output signal for provision of an electrical output signal

The invention claimed is:

1. A method performed a hearing system that includes an accessory device and a hearing device, comprising obtaining, by the accessory device, an audio input signal representative of audio;

obtaining image data using a camera of the accessory device;

identifying one or more audio sources including a first audio source based on the image data;

obtaining a first model comprising first model coefficients, wherein the first model is based on the image data and the audio input signal; and transmitting, by the accessory device, a hearing device signal to the hearing device, wherein the hearing device signal comprises the first model coefficients of the first model.

2. The method according to claim 1, further comprising:

obtaining, by the hearing device, a first input signal representative of sound;

processing, by the hearing device, the first input signal based on the first model coefficients for provision of an electrical output signal; and converting, by the hearing device, the electrical output signal to an audio output signal.

3. A method performed a hearing system that includes an accessory device and a hearing device, comprising obtaining, by the accessory device, an audio input signal representative of audio;

obtaining image data using a camera of the accessory device;

identifying one or more audio sources including a first audio source based on the image data;

obtaining a first model comprising first model coefficients, wherein the first model is based on the image data and the audio input signal;

transmitting, by the accessory device, a hearing device signal to the hearing device, wherein the hearing device signal is based on the first model;

obtaining, by the hearing device, a first input signal representative of sound;

processing, by the hearing device, the first input signal based on the first model coefficients for provision of an electrical output signal; and converting, by the hearing device, the electrical output signal to an audio output signal;

wherein the act of processing the first input signal based on the first model coefficients comprises applying blind source separation to the first input signal.

4. A method performed a hearing system that includes an accessory device and a hearing device, comprising obtaining, by the accessory device, an audio input signal representative of audio;

obtaining image data using a camera of the accessory device;

identifying one or more audio sources including a first audio source based on the image data;

obtaining a first model comprising first model coefficients, wherein the first model is based on the image data and the audio input signal;

transmitting, by the accessory device, a hearing device signal to the hearing device, wherein the hearing device signal is based on the first model;

obtaining, by the hearing device, a first input signal representative of sound;

processing, by the hearing device, the first input signal based on the first model coefficients for provision of an electrical output signal; and converting, by the hearing device, the electrical output signal to an audio output signal;

wherein the act of processing the first input signal based on the first model coefficients comprises applying a neural network to the first input signal.

5. The method according to claim 1, wherein the act of identifying the one or more audio sources comprises determining a first position of the first audio source based on the image data, displaying a first user interface element indicative of the first audio source, and obtaining a user input selecting the first user interface element.

6. The method according to claim 1, wherein the act of obtaining the first model comprises determining a lip movement associated with the first audio source based on the image data, and determining the first model based on the determined lip movement.

7. A method performed a hearing system that includes an accessory device and a hearing device, comprising obtaining, by the accessory device, an audio input signal representative of audio;

obtaining image data using a camera of the accessory device;

identifying one or more audio sources including a first audio source based on the image data;

obtaining a first model comprising first model coefficients, wherein the first model is based on the image data and the audio input signal; and transmitting, by the accessory device, a hearing device signal to the hearing device, wherein the hearing device signal is based on the first model;

wherein the act of obtaining the first model comprises training a deep neural network based on the image data, wherein the deep neural network has N layers, and wherein N is larger than 3.

8. An accessory device for a hearing system comprising the accessory device and a hearing device, the accessory device comprising a processing unit, a memory, a camera, and an interface, wherein the processing unit is configured to:

obtain an audio input signal representative of audio;

obtain image data generated using the camera;

identify one or more audio sources including a first audio source based on the image data;

obtaining a first model comprising first model coefficients, wherein the first model is based on the image data and the audio input signal; and output a hearing device signal for transmission to the hearing device, wherein the hearing device signal comprises the first model coefficients of the first model.

9. The accessory device according to claim 8, wherein the processing unit is configured to identify the one or more audio sources by determining a first position of the first audio source based on the image data, displaying a first user interface element indicative of the first audio source, and detecting a user input selecting the first user interface element.

10. The accessory device according to claim 8, wherein the processing unit is configured to obtain the first model by determining a lip movement associated with the first audio source based on the image data, and determining the first model based on the determined lip movement.

11. An accessory device for a hearing system comprising the accessory device and a hearing device, the accessory device comprising a processing unit, a memory, a camera, and an interface, wherein the processing unit is configured to:

obtain an audio input signal representative of audio;

obtain image data generated using the camera;

identify one or more audio sources including a first audio source based on the image data;

obtaining a first model comprising first model coefficients, wherein the first model is based on the image data and the audio input signal; and output a hearing device signal for transmission to the hearing device, wherein the hearing device signal is based on the first model;

wherein the processing unit is configured to obtain the first model by training a deep neural network based on the image data, wherein the deep neural network has N layers, and wherein N is larger than 3.

12. The accessory device according to claim 8, wherein the processing unit is configured to process an audio signal based on the first model for provision of the hearing device signal.

13. A hearing device comprising:

an antenna for providing an antenna output signal based on a hearing device signal from an accessory device;

a radio transceiver coupled to the antenna for converting the antenna output signal to a transceiver input signal;

a set of microphones comprising a first microphone for provision of a first input signal;

a processor configured to process the first input signal and to provide an electrical output signal based on the first input signal, wherein the processor is also configured to process the transceiver input signal; and a receiver configured to convert the electrical output signal to an audio output signal;

wherein the hearing device signal comprises first model coefficients of a neural network, and wherein the processor is configured to process the first input signal based on the first model coefficients for provision of the electrical output signal;

wherein the hearing device is configured to obtain the first model coefficients of the neural network, and wherein the first model coefficients of the neural network are based on image data and audio data.

14. The hearing device of claim 13, wherein the processor is configured to process the first input signal by applying blind source separation to the first input signal.

15. The hearing device of claim 13, wherein the processor is configured to process the first input signal by applying the first model coefficients of the neural network to the first input signal.

16. The hearing device of claim 13, wherein the neural network comprises a deep neural network.

17. The method of claim 4, wherein the neural network comprises a deep neural network.

* * * * *